United States Patent [19]
Borcher et al.
[11] 4,106,411
[45] Aug. 15, 1978

[54] INCENDIARY FRAGMENTATION WARHEAD

[75] Inventors: Charles A. Borcher, Maitland; William R. Porter, Orlando; Martin H. Harris, Winter Park, all of Fla.

[73] Assignee: Martin Marietta Corporation, Orlando, Fla.

[21] Appl. No.: 609,777

[22] Filed: Sep. 2, 1975

Related U.S. Application Data

[63] Continuation of Ser. No. 103,903, Jan. 4, 1971, abandoned.

[51] Int. Cl.[2] ..... F42B 13/48
[52] U.S. Cl. ..... 102/67; 102/6; 102/24 HC; 102/65; 102/66; 102/90
[58] Field of Search ..... 102/6, 65, 66, 67, 90, 102/24 HC

[56] References Cited

U.S. PATENT DOCUMENTS

| | | | |
|---|---|---|---|
| 2,801,590 | 8/1957 | Balke et al. | 102/90 |
| 3,263,612 | 8/1966 | Throner, Jr. | 102/67 |

FOREIGN PATENT DOCUMENTS

| | | | |
|---|---|---|---|
| 555,279 | 3/1957 | Belgium | 102/67 |
| 636,921 | 9/1963 | Belgium | 102/49.2 |
| 669,449 | 8/1963 | Canada | 102/67 |

*Primary Examiner*—Verlin R. Pendegrass
*Attorney, Agent, or Firm*—Julian C. Renfro; Gay Chin

[57] ABSTRACT

In order to achieve a fragmentation device having a highly effective coupling between the fragments and high explosive used therewith, as well as a very lethal incendiary effect when combined with a pyrophoric ingredient, enabling this device to bring about increased devastation upon supplies or equipment of an enemy, we provide in accordance with this invention a novel layered arrangement in which one or more layers of pyrophoric material such as a zirconium alloy are interposed with one or more well-defined layers of high explosive and fragments, thus making possible very high fragment velocities, a high density, uniform pattern of fragments, and most importantly, a wide dispersion of pyrophoric particles with the fragments that serve to cause immediate conflagration of any oils, fuels or other combustibles that are in the vicinity of the target, or which have been released by the action of the fragments thereupon.

20 Claims, 5 Drawing Figures

INCENDIARY FRAGMENTATION WARHEAD

This is a continuation of patent application Ser. No. 103,903, filed Jan. 4, 1971, and now abandoned.

CROSS REFERENCE TO RELATED APPLICATION

This invention may be regarded as having a definite relationship to the allowed patent application of Borcher and Porter entitled "Layered Fragmentation Device," Ser. No. 249,458, filed Apr. 28, 1972, which is a continuation-in-part of a continuation-in-part application based upon an original application filed Jan. 3, 1966.

BACKGROUND OF THE INVENTION

1. Field of the Invention

This invention relates to fragmentation devices, and more particularly to a device utilizing fragments and explosive in discrete, alternating layers. It also relates to shaped charges. The present invention distinguishes over such weaponry as taught in the above-cited Borcher and Porter application by additionally providing at least one layer of pyrophoric material, preferably interspersed between a layer of fragments and a layer of explosive.

2. Description of the Prior Art

In the past, a number of fragment type warheads have been proposed, but these have suffered from numerous disadvantages, including the fact that a comparatively high explosive-charge-to-metal ratio was required in order to achieve the desired fragment projection velocity. Such prior art configurations typically involved a single explosive burster charge surrounded by fragments, but because of low coupling efficiencies, a considerable amount of explosive was required if desirably high fragment velocities were to be achieved with a limited number of fragments. Catastrophic fires did not usually result from the action of weapons of this type.

SUMMARY OF THE INVENTION

In accordance with the present invention, a novel layered fragmentation device is taught which involves one or more well defined layers of fragments, with each fragment layer being separated by a suitable layer of explosive material. As will be seen, our novel layered fragmentation device may take the form of succession of cylindrical layers; a spherical bomblet designed to rotate as it falls; a stacked longitudinal array of planar layers; or a shaped charged type device, with it being understood that in each instance, at least one layer of pyrophoric material is used, typically disposed between a layer of fragments and a layer of explosive. The arrangement is such as to enable the substantially simultaneous detonation of the explosive layers and hence an effective, uniform, high density fragment pattern, but even more significantly, an incendiary effect creating immediate and catastrophic fires as a result of the inclusion of the pyrophoric material.

The present novel weapon distinguishes over all known prior art explosive devices by the fact that it contains pyrophoric fragmentating material, either with or without nonpyrophoric fragmenting material. The term pyrophoric as used herein relates to metals and alloys which exhibit pyrophoric effects in response to impulse from detonation and/or impact. For such alloys and metals to be technically useful, the mechanically separated burning particles must be hot enough and retain a sufficiently high combustion temperature long enough to ignite suitable substances such as combustible gases or liquid or solid fuels. The pyrophoric substances must be sufficiently stable to be suitable for rough handling and to resist for sufficiently long periods the corrosive influences to which they are subjected in normal use.

In other words, the term pyrophoric denotes a material, usually a metal alloy, which is ignited in a weapon detonation, and continues to support combustion. The pyrophoric material we use is in a form or state which will not ignite spontaneously, and hence is quite safe to handle. The incendiary effects brought about in accordance with this invention result from the inclusion of the pyrophoric material.

Because of the positioning of this material with the other components of the munition, upon detonation of the explosive, the fragments are caused to disperse, and the pyrophoric material caused to break into a very large number of small pieces, some of which are caused to be clad to the fragments, while others of the small pieces of pyrophoric material are propelled through the air by themselves. Because these particles are at a temperature of approximately 3,500° K, they cause an immediate and catastrophic fire when they come into contact with diesel fuel, oils, lubricants, other combustibles, and most violently with fuels of a highly volatile nature such as gasoline.

In a preferred embodiment, the external case of the munition is a hard metal such as steel, tungsten carbide, or similar material, immediately inside of which may be a thin liner or layer of pyrophoric material such as zirconium tin. Immediately inside the zirconium tin layer may be a layer of explosive, compatible with the zirconium tin, and amounting to an arrangement which may be handled safely and which is nontoxic. Such explosives may for example include Composition B, cyclotol, octol, and C-4.

Thus, a single layer of fragments, zirconium alloy and explosive amounts to a lethal arrangement that may be effectively used in a comparatively small weapon such as a bomblet. Other arrangements within the spirit of this invention may include two or more layers of fragments, zirconium alloy, and explosive, although in many instances it will not be necessary to have zirconium alloy inside each fragmentation layer. Also, the zirconium alloy or other pyrophoric material may be disposed other than between the fragment and explosive layers, and may for example be disposed outside the fragment layer.

With regard to the use herein of pyrophoric metal, it is known that when such metal is subjected to an explosive shock, brittle fracture occurs. This disintegration exposes hot metal to the atmosphere and since pyrophoric metals are highly reactive with oxygen, a rapid oxidation or burning occurs on the bared surface. This process occurs slower under ambient conditions and normally is terminated when a thin oxide layer is built up on the surface, protecting the nascent metal of the interior volume from contact with oxygen. However, if the local temperature at the surface can be maintained above the metal-oxide melting point, the oxide is continually removed and the burning is sustained. The ability to maintain this high temperature is believed to be the fundamental attribute of effective pyrophoric metals.

The energy (heat of combustion) released through combustion of the metal surface tends to increase the temperature, while both conduction and radiation tend to reduce the temperature. All three processes are rate limited: combustion, by surface area and available oxygen; conduction, by internal temperature gradient, particle mass and thermal conductivity; and radiation, by external temperature gradient and emissivity.

As particle size is decreased, the internal volume decreases faster than the surface area since these are proportional to the cube and square respectively of the linear dimensions. When volume is small, loss of heat by conduction is minimized since there is no large mass of metal to function as a "heat sink." Therefore, smaller particles of any material are more likely to sustain burning. For each type of pyrophoric metal there is a critical particle size for maximum support of combustion. Larger fragments would be rapidly extinguished, smaller fragments would be more rapidly consumed. Maximum burning time as interrelated to fragment size and velocity is desired for pyrophoric munitions to increase effective range and probability of ignition of target materials.

Several "transition temperatures" may exist for one metal or alloy due to different changes in oxidation rate occurring at different temperatures. The correct transition temperature is important to incendiary action. For example, titanium has a "transition temperature" near 850° C due to a second type of oxide forming, but probably the true transition temperature is higher where the oxide is dissolved in the metal. Thus, titanium is probably a transition temperature controlled metal rather than a critical temperature controlled metal as suggested by some.

The pyrophoric material size effect warrants further comment. Fine particles have a higher surface to volume ratio so that as the particles oxidize the relatively larger amount of heat produced per unit volume by oxidation will cause higher temperatures in the particles. Thus, smaller particles will ignite where the same material in bulk form will not ignite.

If the ambient air pressure is lower (for example, at high altitudes), the ignition temperature may be lowered. This effect is believed to be due to the fact that the vapor pressure of the metal can be greater than the pressure of the surrounding atmosphere. The pressure differential can rupture the protective oxide seal. Aluminum and zinc are believed to behave in this manner.

The explosion of the munition does several things to the pyrophoric metal. It supplies energy producing heat and causes metal fracture. Fresh metal surfaces are exposed both from the metal to metal fracture and the spalling of oxide layers where present. The resulting metal particles can be heated above the critical or ignition temperature by the explosion and will be self-heated toward the flame temperature.

Much work has gone into studying metal burning, and a number of models have been postulated. Most models are similar in many respects, for example, the vaporization of the metal from the particle and the oxidation of the metal vapor in the flame. One theory suggests two reaction zones around the metal particle. In the inner zone, metal vapor and oxygen produce oxide vapor by a homogeneous reaction. A supersaturation of oxide vapor results in rapid nucleation and some condensation of oxide on oxide. The heat of oxidation and of condensation is liberated so that the inner zone is the hottest. Condensed oxide particles grow in size as they are convected toward the outer zone, where the condensed oxide particles pile up to form the outer luminous edge of the flame.

The novel weapon configuration of the present invention makes it possible to effectively use the fragmenting device to perforate fuel containers, to volatilize the fuel by hydraulic ram action of fragments passing into fuel at high velocity, and causing the particles of burning pyrophoric material to violently ignite the volatilized fuel and the total fuel within the container.

When the explosive is detonated, both the pyrophoric liner and the steel case will fragment and be driven outwardly from the munition at high velocity. Tests have confirmed that the pyrophoric material creates a large plurality of burning particles exiting from the warhead. These particles may be independent of the steel fragments, or may be bonded to the steel fragments as a result of the detonation. High speed photographs have shown that a 0.050 inch sheet of zirconium alloy behind a layer of 30 grain steel fragments will create literally thousands of burning zirconium alloy particles which saturate the target area, assuring ignition of fuels volatilized by the steel fragment portion of the warheads, as well as the destruction of other materials by penetration and/or perforation. Mechanical action of steel fragments coupled with high temperature burning pyrophoric particles thus results in violent ignition of fuel in containers.

It is therefore a primary object of this invention to provide a highly effective and particularly devastating incendiary fragmentation warhead.

It is another object of this invention to provide a novel weapon configuration involving the layering of pyrophoric and explosive material.

It is still another object of this invention to provide a weapon configuration involving alternate layers of explosive, pyrophoric and fragmentation material, amounting to an arrangement capable of creating catastrophic fires.

Other objects, features and advantages will be more apparent from a study of the appended figures of drawing in which.

DETAILED DESCRIPTION

Figure 1:
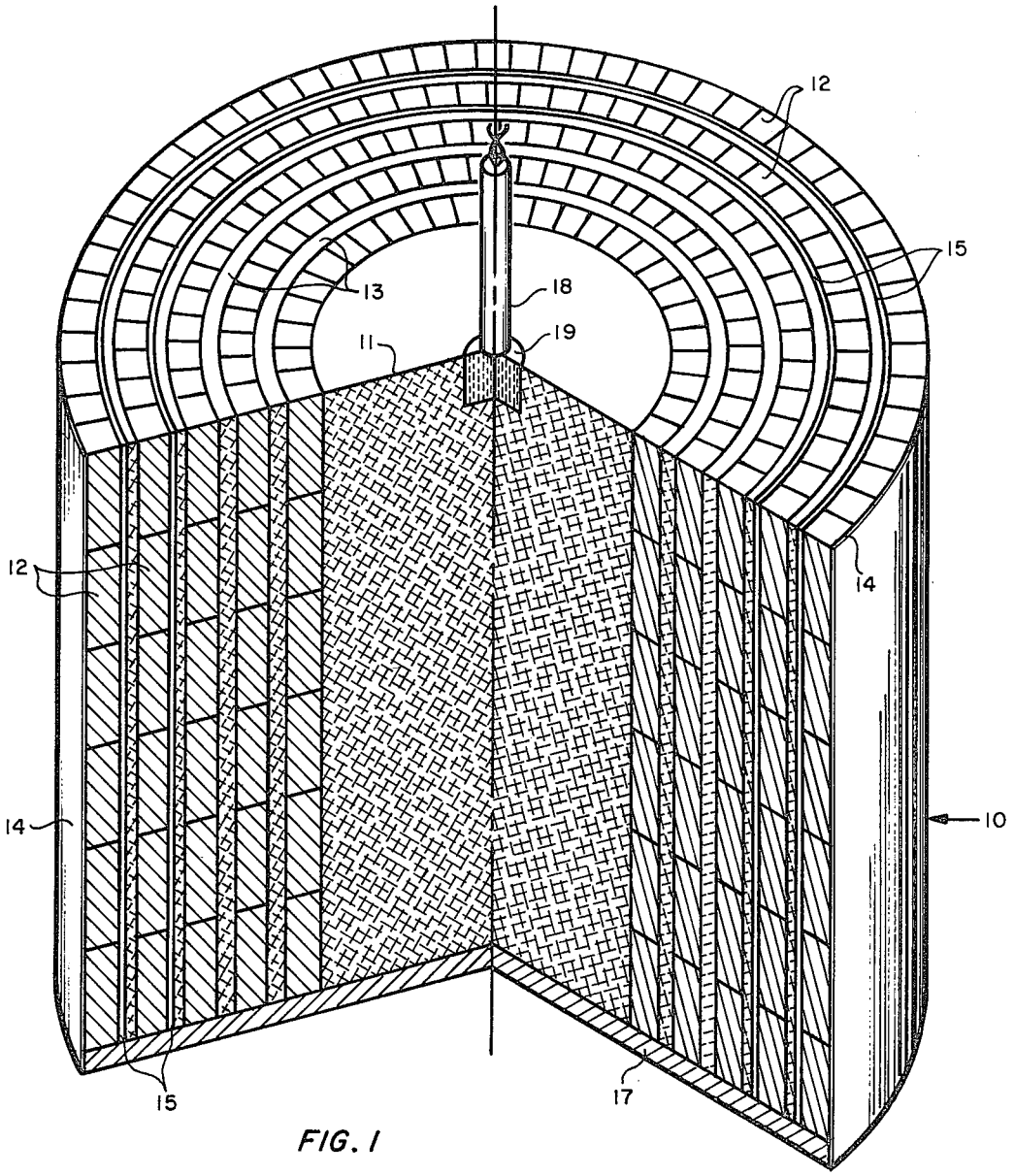
FIG. 1 is an illustrative sectional view of one form of a novel incendiary fragmentation warhead in accordance with this invention, revealing concentric layering of explosive, pyrophoric and fragmentation materials.

Turning now to FIG. 1, it will be revealed that layered device 10 has a center burster 11, around which are arrayed numerous fragments, such as rods 12 that are deployed in alternate discrete cylindrical layers with explosive layers 13. As will be evident from this figure, the rods 12 in this weapon embodiment are each in the configuration of a discrete rectangular solid, with the rods in each layer being arranged in several parallel rows to form a generally cylindrically-shaped configuration. In the present illustration, several rows of rods are employed, but it is of course to be understood that a larger or smaller number may be employed if desired. Each such fragment layer amounts to an essentially solid structure, extending around the warhead. The rods 12 can be of low carbon steel and possess a length to thickness ratio of 1 to 1 to >30 to 1.

It will also be noted that some five layers of rods are employed in this illustrative embodiment, and between each layer of rods a discrete layer of explosive 13 is disposed. Detonation of the center burster 11 is brought about by a conventional electric initiator 18, which in turn causes the booster 19 to function and detonate the explosive center burster. The several explosive layers are detonated substantially simultaneously through either shock initiation through the rods, or through use of an explosive disc 17 on one or both ends of the cylinder. At such time the rods are caused to be blown outwardly at substantial velocity, with an enhanced velocity profile and in a highly controlled pattern. The outermost layer is typically surrounded by a casing 14, such as a Fiberglas cover, although if the outermost layer of fragments is to be created from a scored cylinder, the scored cylinder serves as the casing.

Quite significantly, by the use of alternate layers of rods and explosive all in direct contact, very effective coupling of explosive to fragments is brought about, with resultant high velocities and effective patterning that will enable an enemy target to be dealt a crippling blow if detonation of our warhead takes place within a reasonable range thereof. Spherical fragments, which, because of their relatively small contact area with the explosive, may be desirable for minimizing fragment velocity while creating a velocity gradient, whereas fragments in the nature of rods or cubes are to be used when velocity gradients are desirable and fragment velocities are to be maximized.

With regard to velocity gradient, such is achieved within the fragment pattern through the layering technique. This velocity gradient spreads out the fragment pattern in depth to increase the hit probability of the fragments. When the explosive central charge is initiated, it expands against the enclosing fragment layers, thus compressing the high explosive between the fragment layers and adding energy to the explosive. When the explosive is then shock initiated, the fragments are propelled at a higher velocity because of the greater explosive energy density. The outermost fragment layer has the highest velocity because it is surrounded by atmospheric pressure externally and detonation pressure internally, while the internal layers are surrounded by detonation pressure.

As will be noted in FIG. 1, in accordance with the present invention we utilize at least one shell or sheet 15 of pyrophoric material such as of zirconium alloy, disposed between an explosive layer and an adjacent fragment layer. In this illustrated embodiment, two shells 15 are utilized, disposed between the two outermost explosive layers, and the respective fragment layers outboard of these explosive layers. Although other configurations are of course possible within the spirit of this invention, we have been most successful when using zirconium tin in a thickness such as 0.050 inch, which material may be preformed so as to fit properly between a given explosive layer and the fragments immediately outboard of that explosive layer. In such instances, we prefer to use 30 grain steel fragments, but other fragment weights perform essentially as well in the warhead. Obviously, other weights may be used if the target vulnerability so requires, and other nonpyrophoric fragment layers than steel may be employed.

Upon detonation of the explosive layers in accordance with the techniques taught in copending application Ser. No. 249,458, the fragments are caused by the detonation to move rapidly outwardly away from the munition at high velocity, with the pyrophoric liners 15 of course being caused to break up into small pieces, which pieces also move outwardly from the munition at high speed. Although in most instances the pyrophoric material travels outwardly as discrete pieces, it is also possible in some instances for the nonpyrophoric fragments to in effect become partially "cladded" or "bonded" with the pyrophoric material, with the result that the heavy fragments actually are in such instance capable of not only perforating the target but also causing fire or an explosion therein.

The usual circumstance is for the heavy steel fragments to travel outwardly and perforate the target, which of course may include fuel containers. In such instances, the hydraulic ram action of the fragments passing into the fuel at high velocity causes the fuel to volatilize, which enhances the chance of this fuel exploding in instances when glowing pyrophoric fragments arrive shortly after this perforation. High speed motion pictures have revealed that literally thousands of burning pyrophoric particles at roughly 3500° K saturate a target area subsequent to the detonation of an explosive device in accordance with this invention, and this assures the ignition of fuels volatilized by the action of the heavy fragment portions of the warhead.

It is to be realized that we are not to be limited to the use of five rows of fragments as shown in FIG. 1, nor limited to two shells 15 of pyrophoric material, for obviously within the spirit of this invention these quantities could be changed. Tests have confirmed that the use of dense, fragmentable material such as of steel in our warhead enables superior results to be obtained in most instances. Although we may of course use only fragments of pyrophoric material on some occasions, because of the lesser density of such material and its tendency to break into small pieces, we have found that fragments of pyrophoric material simply do not perforate the targets as well as do the heavier steel fragments, and thus by themselves do not serve as satisfactorily to cause the ignition of fuel or other combustibles contained in or associated with most targets.

Tests have also shown that it is highly desirable to utilize an optimum ratio of ignited surface area relative to the mass of the pyrophoric material. Without this optimum ratio, the heat generated by the burning surface area is insufficient to sustain burning because of heat loss to the nonburning mass. For this reason, the present configurations provide for the breakup of the pyrophoric liner material and thus igniting a large number of burning particles.

Usable in lieu of or in addition to the zirconium mixtures and alloys, the pyrophoric material may be selected from a group consisting of mixtures and alloys of titanium, aluminum, magnesium, cesium, iron, copper, and pyrophoric combinations thereof.

A typical layered device as depicted in FIG. 1 might for example contain three layers of 30 grain steel fragments, having a total weight of 14 pounds, containing 8 pounds of fragments, 5 pounds of explosive, and 1 pound of zirconium tin or other pyrophoric material. This warhead would have an L/D of approximately 2. Firing tests have demonstrated that when initiated simultaneously at both ends, the fragment velocity will range between 3,000 and 7,500 feet per second. It was also observed in the same tests that the pyrophoric material in thousands of small particles was ejected with a velocity of approximately 1,000 to 7,500 feet per second. This warhead has been vividly demonstrated to set fuel fires repeatedly at distances of 75 feet. Thus we see the invention herein described adds to a standard type warhead without pyrophoric material, the capability of violently igniting volatile fuels so that destruction by fire can be achieved in addition to the perforation of the target by fragments.

Figure 2:
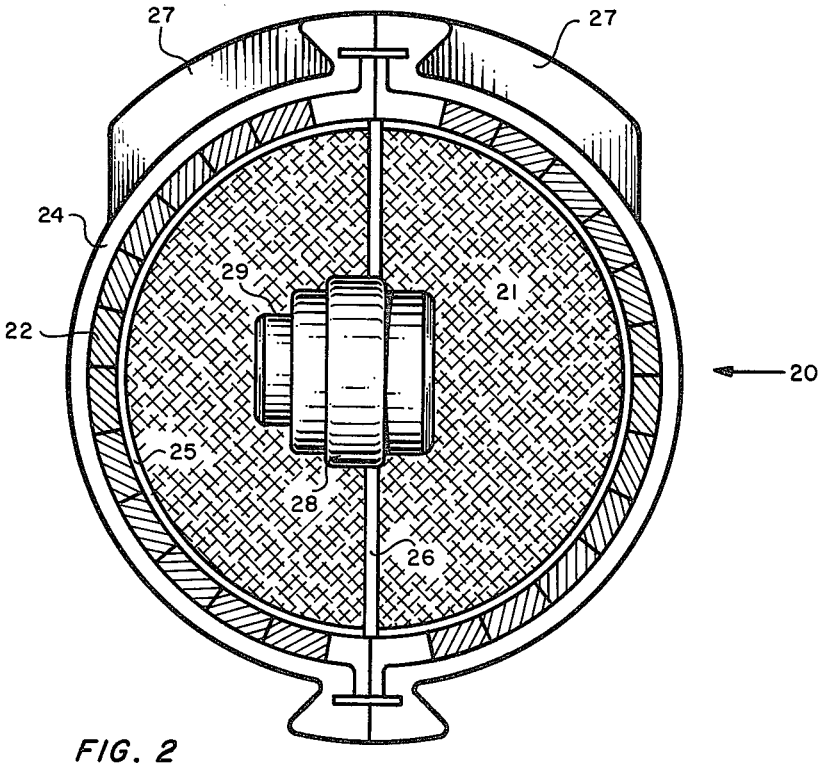
FIG. 2 is a cross-sectional view of a bomblet incorporating some of the teachings of the present invention pertinent to the use of pyrophoric material.

Turning to FIG. 2, it will there be noted that we have illustrated the cross-sectional appearance of a bomblet 20 utilizing our novel teachings and configurations. Similar reference numerals to those used in FIG. 1 will be noted to have been employed in conjunction with the embodiments of FIG. 2 and figures following. The interior of the bomblet is formed by high explosive 21 surrounded by a fragment layer 22 that in turn is sheathed by a tough plastic case or casing 24. This case is preferably formed in two halves or hemispheres that have been carefully formed so as to properly interfit as shown in FIG. 2. Preferably four sets of fins or wind vanes 27 are disposed at spaced locations about the periphery of the weapon, at the juncture line, with one-half of each fin being disposed on each hemisphere. The fins are configured along one edge to catch the air as the bomblet is dropped and are smooth along the other edge, with the air-catching edges being aligned in a rotative sense so that all the fins contribute to causing rotation of the bomblet in a common direction.

Immediately inside the plastic case 24 is the fragment array 22, which may utilize either discrete fragments, or hemispherical members that have been "coined" or otherwise configured such that breakup of the fragment array into separate fragments occurs at such time as the high explosive 21 in the interior of the bomblet is caused to detonate. Preferably such detonation is brought about by action of a fuze 28 that causes the arming of the device after a number of revolutions have taken place, or a critical spin rate is achieved as a result of the action of the fins 27. More particularly, this type of weapon is typically released at altitude, and allowed to fall to the ground in enemy territory. In falling through the air, a very rapid spinup of the weapon is brought about by the action of the fins which thus arm the fuze, permitting detonation on impact. A booster 29 may be used adjacent the fuze 28 to assure the detonation of the main explosive 21.

In accordance with this invention, we utilize a pyrophoric liner 25 between the explosive material 21 and the fragment array 22. This liner may be in two halves or hemispheres that are configured so as to interfit between the components 21 and 22, and is preferably of zirconium tin, say 0.050 inch thick.

As in the case of the device in accordance with FIG. 1, upon the detonation of the explosive material in the bomblet, the pyrophoric material is caused to break up, and to accompany the metallic nonpyrophoric fragments as they fly outwardly at great speed from the device. The fragments of course serve to pentrate the target, and the pieces of pyrophoric material serve to ignite explosive vapors in a very effective manner. A felt pad 26 may be placed between the two explosive halves.

A typical bomblet as illustrated in FIG. 2 is generally spherical, weighs approximately 2½ pounds, and is approximately 4 inches in diameter. This bomblet may be comprised of 6/10th of a pound of high explosive 21, ¼ pound of pyrophoric material 25, and approximately 1½ pounds of steel fragments, with the pyrophoric material and the fragments being disposed in a concentric array. The balance of the weight is of course made up by the plastic case and the fuze.

From the standpoint of performance, upon firing of the fuze, the explosive charge is detonated, causing the fragments to be ejected at a velocity of about 4,200 feet per second. The pyrophoric material is also caused to break up in the detonation and is ejected over a velocity range which will be from as little as 500 fps to as much as 4,200 fps. Of course, these velocities depend upon the ratio of weight of explosive material to the weight of the fragments and other structural material being ejected. Thus, we see that this small weapon typically ejects a large number of 30 grain steel fragments at 4,200 fps, and the pyrophoric material along with the fragments to literally saturate the target area with thousands of metallic particles burning at around 3500° K. This munition has been successfully demonstrated to start highly destructive fuel fires in trucks, aircraft, fuel tanks, and the like, whereas the same munition without the pyrophoric material does not enjoy the benefit of the high probability of destruction by fire.

Figure 3:
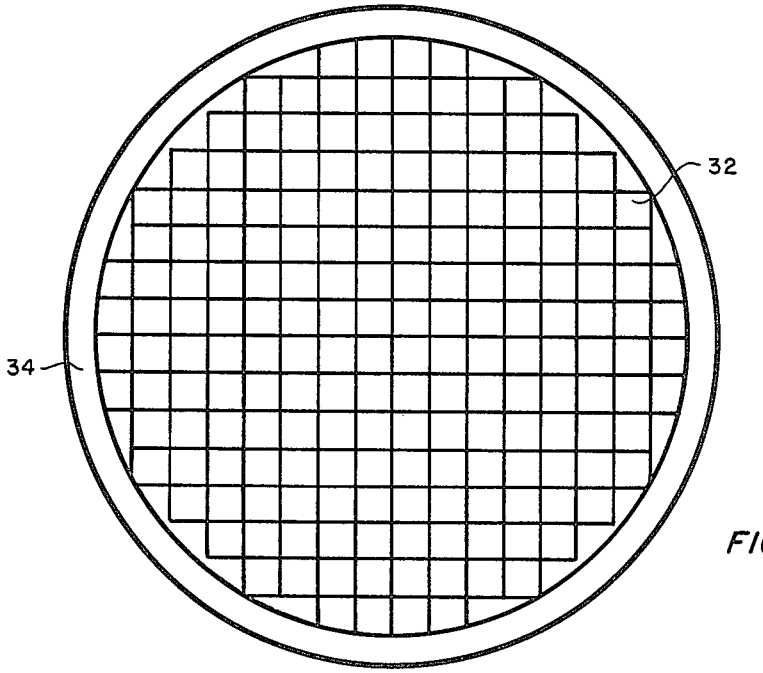
FIG. 3 is a top view illustrating the use of fragments in a weapon utilizing axial layering.
Figure 4:
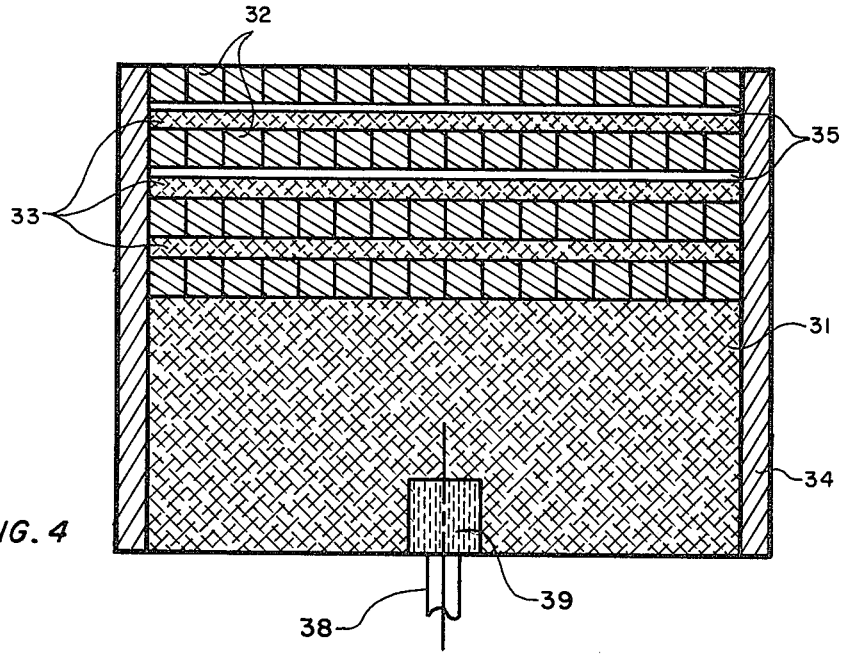
FIG. 4 is a side elevational view related to FIG. 3, in which further details of axial layering are revealed, including the use of pyrophoric material.

FIGS. 3 and 4 represent a warhead sometimes referred to as an axial projector warhead that has, for example, four fragment layers 32, with each such layer being separated by an explosive layer 33, and with all of the foregoing disposed above a cylindrical explosive charge 31, and contained within a metallic case 34 such as of steel.

In accordance with this invention, we provide say two layers of pyrophoric material 35, such as of zirconium tin, with one of such layers disposed between the uppermost fragment layer and the adjacent explosive layer, as best seen in FIG. 4, and the other pyrophoric layer disposed between the next lower fragment layer and its respective explosive layer.

Firing the detonator 38, by electrical energy or by firing pin causes the booster 39 to detonate and transfer the detonation to the main charge 31. Since the detonation wave travels outward from the booster in all directions and the fragments are nonuniformly oriented around the booster, such fragments tend to be ejected at very high velocity in a narrow pattern away from the booster. Velocity gradient in the layers is as described above and in copending patent application Ser. No. 249,458, and ignition of the pyrophoric material and its target interaction is as described hereinbefore.

Figure 5:
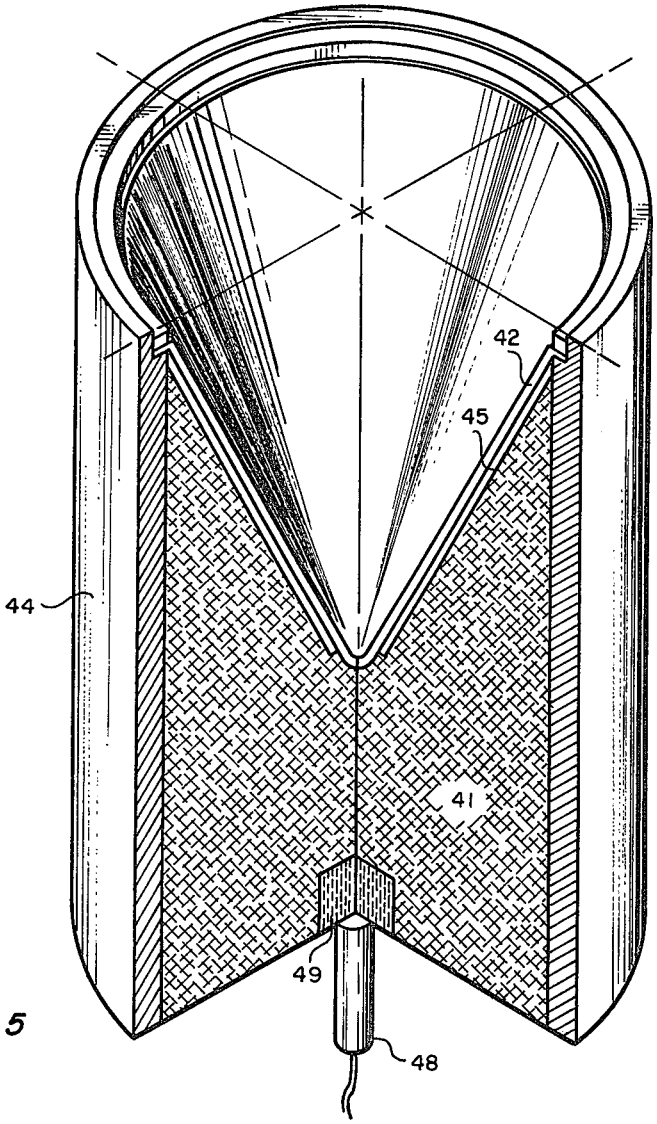
FIG. 5 is a perspective view, partly in section, to reveal the use of a pyrophoric liner in a shaped charge type weapon.

FIG. 5 represents another embodiment wherein pyrophoric material is employed in accordance with this invention, being used here to enhance the effectiveness of a standard type shape charge munition. In this weapon, the pyrophoric liner takes generally the form of a cone 45, which is placed adjacent to the usual copper cone 42 of a shape charge munition. The pyrophoric liner is thus placed between the copper cone and the high explosive material 41, in a somewhat similar manner to the previously described devices, wherein it is placed between fragments and explosive material. The pyrophoric conical liner may be in the form of a truncated cone fitting snugly to the copper cone or it may be in the form of a cap over the entire copper cone. The outer case 44 may be of aluminum or steel.

Performance of this munition is as follows:

Firing the detonator 48 causes detonation of the booster 49 which then transfers the detonation to the explosive charge 41. As the detonating explosive charge progresses toward the shape charge cone 42, the cone is caused to collapse in the normal shape charge manner to form a jet which will perforate target materials. Through the addition of the pyrophoric liner 45 to the copper cone, we now not only perforate heavy target materials but we cause burning pyrophoric material to be introduced through the perforation brought about by the copper cone, into the chambers such as tanks, trucks, APC's, etc., thereby causing a harsh environment for personnel, or igniting gasoline, diesel fuels, or other materials which may be contained within the target. It has been demonstrated that a 1½ inch diameter copper cone shape charge without pyrophoric material will penetrate a 1½ inch steel plate but will not ignite a container of diesel fuel 4 feet behind the steel plate. With the addition of the pyrophoric material to such a shape charge device, we now enhance capability so that the diesel fuel under the same conditions is quickly ignited. As with the other embodiments of this invention, we are not limited in either size or weight in munitions to which we may apply the pyrophoric material.

As should now be apparent, we have provided in accordance with this invention a novel incendiary weapon, comprising explosive and pyrophoric material disposed in conjunction with a metal layer, whereby upon detonation of the explosive material, the pyrophoric material and metal layer are caused to be co-dispersed. Although the pyrophoric material is preferably directly adjacent to the metal layer, this is not a firm requirement, and although the metal layer is preferably of a relatively heavy, fragmentable, nonpyrophoric metal, the metal layer may also be of a fragmentable pyrophoric material, or even be funnel shaped, and an ingredient of a shaped charge device.

The explosive and pyrophoric material may be in the form of concentrically disposed layers, with the layers either being generally cylindrically disposed or generally spherically disposed, or alternatively, the layers may be substantially planar. In each of these instances, only a single layer of such materials may be used, or alternatively, multiple layers employed. In the event more than one layer of explosive is utilized, the arrangement is such that the explosive layers are detonated substantially simultaneously.

End plates may be used for increasing the confinement of the explosive, thereby causing the fragments and pyrophoric material to be projected within a very narrow beam spray. These end plates may be massive metallic plates, or alternatively may be made of explosive material. An initiator may be disposed in each of the plates of the latter type, which initiators are electrically interconnected so that they may be simultaneously detonated.

Figure 6:
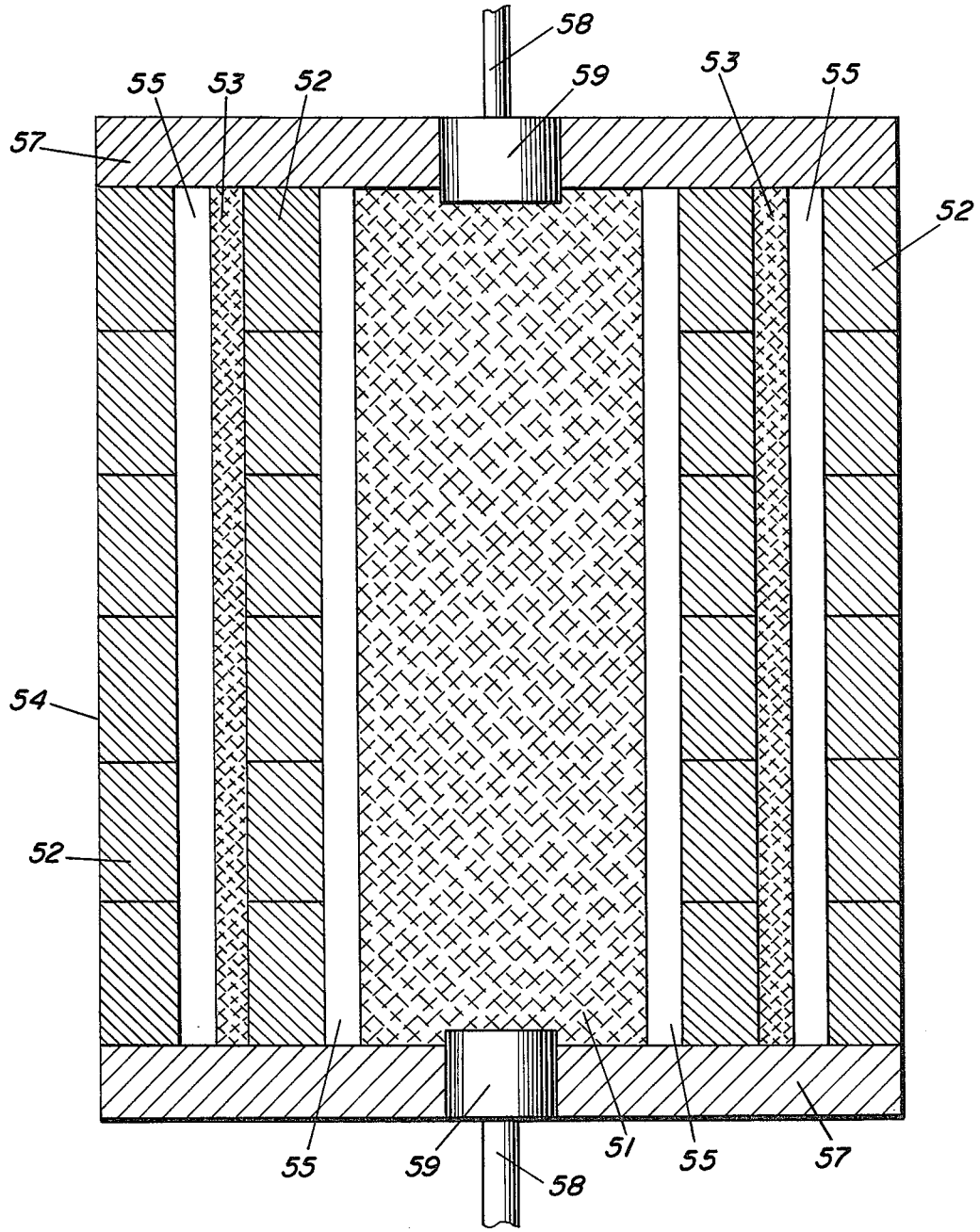
FIG. 6 is a sectional view of an alternative embodiment of a novel incendiary fragmentation warhead in accordance with this invention.

An embodiment of this latter type is illustrated in FIG. 6, which involves an explosive end plate 57 at each end of the weapon, as well as a plurality of layers. These are contiguous yet separate layers, and involve one or more fragment layers 52, one or more pyrophoric layers 55, and one or more layers of explosive material 53, with all of these layers extending substantially continuously between the end plates 57, and around center burster 51. The outermost layer of a weapon of this type is surrounded by a casing 54.

It is to be noted that each of the explosive end plates is provided with an electric initiator 58 connected to a booster 59, and each booster is in contact with the center burster 51. As previously mentioned, we prefer to detonate the detonators 58 substantially simultaneously, so that the detonation of the explosive material can proceed essentially uniformly.

The pyrophoric material can, as previously explained, either be zirconium, or else some mixture or alloy of zirconium with tin such as with the tin being used in percentages from say 1% to 15%. Also, the pyrophoric material may be selected from a group of materials evidencing pyrophorisity, consisting of zirconium, titanium, aluminum, magnesium, cesium, iron, copper, or some pyrophoric combination of any of these.

It should now be obvious that we have provided a novel and highly effective Incendiary Fragmentation Warhead, in which lethality to vehicles, stores and the like is greatly enhanced over previous warheads, in that the inclusion of pyrophoric material causes immediate and catastrophic fire in containers of volatile fuels and combustibles which in accordance with technology of the prior art, were usually only perforated by the fragments, thereby permitting field repair without destruction by fire.

We claim:

1. A layered incendiary fragmentation device designed to project fragments in a highly controlled pattern, comprising at least two layers of fragmentable material, and at least two layers of explosive material, with a layer of explosive material being utilized for each layer of fragmentable material, at least one layer of pyrophoric material disposed with said fragmentable and explosive layers, said layers being adjacently disposed, yet separate and substantially continuous, extending for a substantial portion of a major dimension of the device, and means for bringing about the detonation of said explosive layers substantially simultaneously so as to cause the outward projection of fragments and pyrophoric material.

2. The layered fragmentation device as defined in claim 1 in which said layers of explosive and fragmentable material are formed into a substantially cylindrical configuration, at each end of which is utilized an end plate for assuring a narrow beam spray angle.

3. The layered fragmentation device as defined in claim 2 in which said end plates are of relatively massive metallic construction.

4. The layered fragmentation device as defined in claim 1 in which said fragments are in the form of discrete rectangular solids.

5. The layered fragmentation device as defined in claim 1 in which said fragments are in the form of rectangular solids formed by coining into metallic plate.

6. The layered configuration as defined in claim 1 in which said layers are concentric, being disposed in a generally cylindrical arrangement.

7. The layered configuration as defined in claim 1 in which said layers are concentric, being disposed in a generally spherical arrangement.

8. The layered fragmentation device as defined in claim 1 in which said layers are parallel layers oriented along the axis of a cylinder.

9. A layered incendiary fragmentation device designed to project fragments in a highly controlled pattern, comprising at least one layer of fragmentable material, with a layer of explosive utilized for each layer of fragmentable material, at least one layer of pyrophoric material disposed with said fragmentable and explosive layers, and means for bringing about the detonation of said explosive layers substantially simultaneously so as to cause the outward projection of fragments and pyrophoric material, said layers of explosive and fragmentable material being formed into a substantially cylindrical configuration, at each end of which is utilized an end plate for assuring a narrow beam spray angle, said end plates being of explosive material, each with its own initiator.

10. A layered warhead for projecting a multitude of fragments in a controlled pattern comprising interspersed layers of fragmentable material, explosive, and pyrophoric material, and means for detonating said explosive material so as to bring about the outward projection of fragments and pyrophoric material, said layered warhead utilizing a plurality of layers of each material, with the layers of explosive being detonated substantially simultaneously.

11. The layered warhead as defined in claim 10 in which said pyrophoric material is selected from a group consisting of zirconium mixtures and alloys.

12. The layered warhead as defined in claim 10 in which said pyrophoric material is a material selected from the group consisting of zirconium, titanium, aluminum, magnesium, cesium, iron, copper, as well as certain pyrophoric combinations of any of these.

13. The warhead as defined in claim 10 in which pyrophoric material is directly adjacent to a layer of fragmentable material.

14. The warhead as defined in claim 10 wherein said fragmentable layer is of a relatively heavy, fragmentable, nonpyrophoric metal.

15. The warhead as defined in claim 10 wherein said fragmentable layer is of pyrophoric material.

16. The warhead as defined in claim 10 wherein said explosive and pyrophoric materials are generally in the form of concentrically disposed layers.

17. The warhead as defined in claim 16 in which a layer of fragments is generally concentric along with the layers of explosive and pyrophoric material.

18. The warhead as defined in claim 17 in which said layers are concentric in that they are generally cylindrically disposed.

19. The warhead as defined in claim 10 in which the explosive and pyrophoric materials are in the form of substantially planar layers.

20. A layered warhead for projecting a multitude of fragments in a controlled pattern comprising interspersed layers of fragmentable material, explosive, and pyrophoric material, and means for detonating said explosive material so as to bring about the outward projection of fragments and pyrophoric material, said pyrophoric material being principally zirconium, but with 1% to 15% tin by weight added.

* * * * *